US008307513B1

(12) United States Patent
Fitzgerald

(10) Patent No.: US 8,307,513 B1
(45) Date of Patent: Nov. 13, 2012

(54) DOOR HINGE WITH INTEGRATED PRESET STOPS

(75) Inventor: Michael W. Fitzgerald, Huntersville, NC (US)

(73) Assignee: PinStop USA, LLC, Charlotte, NC (US)

( * ) Notice: Subject to any disclaimer, the term of this patent is extended or adjusted under 35 U.S.C. 154(b) by 623 days.

(21) Appl. No.: 12/361,528

(22) Filed: Jan. 28, 2009

(51) Int. Cl.
*E05D 5/10* (2006.01)

(52) U.S. Cl. ..... 16/386; 16/344; 16/375

(58) Field of Classification Search ..... 16/344, 16/374, 375, 377, 386, 334, 381, 380, 342, 16/362, 363, 82; 292/288, DIG. 17, DIG. 15
See application file for complete search history.

(56) References Cited

U.S. PATENT DOCUMENTS

| | | | | | |
|---|---|---|---|---|---|
| 353,007 | A | * | 11/1886 | Schubert et al. | 16/381 |
| 1,030,801 | A | * | 6/1912 | Berault | 16/262 |
| 1,455,550 | A | | 5/1923 | Rodell | |
| 1,683,814 | A | | 9/1928 | Block | |
| 2,930,075 | A | | 3/1960 | Deutchman et al. | |
| 2,993,226 | A | | 7/1961 | Baker, Jr. et al. | |
| 3,000,049 | A | * | 9/1961 | Terry, Jr. | 16/334 |
| 3,015,126 | A | * | 1/1962 | Ahlgren | 16/386 |
| 3,538,539 | A | * | 11/1970 | Allison | 16/375 |
| 3,602,942 | A | * | 9/1971 | Neff et al. | 16/375 |
| 5,287,596 | A | | 2/1994 | Chen et al. | |
| 5,765,263 | A | | 6/1998 | Bolinas et al. | |
| 6,317,928 | B1 | | 11/2001 | Guillemette | |
| 6,353,967 | B1 | | 3/2002 | Escobar et al. | |
| 6,591,453 | B2 | | 7/2003 | Jenks | |
| 7,000,290 | B1 | | 2/2006 | Ace | |
| 7,197,791 | B1 | | 4/2007 | Smith | |
| 7,891,055 | B1 | * | 2/2011 | Combs | 16/342 |
| 2007/0067959 | A1 | * | 3/2007 | Smith | 16/375 |

* cited by examiner

*Primary Examiner* — Jeffrey O'Brien
(74) *Attorney, Agent, or Firm* — Everman Law Firm, P.A.; Gregory R. Everman

(57) ABSTRACT

A hinge for a swinging door. The hinge includes first and second leafs, each having knuckles, and a pin which rotatably attaches the first and second leafs together. The first knuckle of the first leaf includes a detent, the first knuckle of the second leaf includes first, second, and optionally third, channels, and the pin includes first and second ribs. The first rib is positioned within a desired channel thereby fixing the relative position between the pin and second leaf and predetermining the swing range of the door, which is restricted when the detent engages the first rib. The second rib acts as a spacer to keep the pin from moving away from and over the detent when the door has reached its predetermined swing range. In this fashion, the hinge limits the swing range of a door to keep the door from striking an adjacent wall.

8 Claims, 12 Drawing Sheets

DOOR HINGE WITH INTEGRATED PRESET STOPS

BACKGROUND OF THE INVENTION

1. Field of the Invention

The present invention relates to the field of hinges for doors and, more specifically, to hinges that provide stops for a door at predetermined degrees of being open in order to restrict the door from striking an adjacent wall.

2. Description of the Related Art

Conventional doors are supported on a door jamb by a plurality of hinge sets which allow for the door to pivot between a closed position and an open position. Typically, such swinging doors are provided with one of numerous well-known stops in order to prevent the opening of a door from causing damage to the door, door knob or adjacent wall.

For example, floor and baseboard mounted door bumpers are effective at keeping a door from striking an adjacent wall. However, these bumpers damage the surface to which they are mounted, can damage the door as it strikes against the bumper, may be a tripping hazard and are generally unaesthetic.

As another example, it is well known to adhere a strike plate on the wall that is adjacent to the swinging door. Such strike plates provide a surface against which the door knob strikes. Disadvantageously, these strike plates are fairly large and look awkward on the wall, particularly when the door is closed.

Hinge pin door stops are also conventionally known. These stops include two padded posts which respectively engage against the door and adjacent wall when the door is fully opened. While these stops function adequately for their intended purpose, repeated impact of the post against the hollow core door or adjacent wall will often result in damage. Repeated use also causes the padding to break down, resulting in more aggressive damage to the door or wall.

In an attempt to overcome the limitations of the aforementioned door stops, a variety of door stops are known in which the hinge has been modified and/or additional parts added thereto in order to reduce the likelihood of the respective stop from damaging the door or adjacent wall. For example, such door stops are described in U.S. Pat. Nos. 7,197,791; 6,353,967; 5,765,263; 1,683,814 and 1,455,550. However, such door stops are overly complicated in their configuration, difficult to manufacture, include additional parts that could be lost and/or may not be sufficiently robust to withstand significant force and fatigue.

Accordingly, there is a need in the art of continued improvement of door stops. Particularly, there is a need for a door stop that is simple in configuration, has the appearance of a normal door hinge when in use, will not cause damage to the door or adjacent wall and is capable long term repeated use without requiring repair or replacement.

BRIEF SUMMARY OF THE INVENTION

To achieve the foregoing and other objects, the present invention, as embodied and broadly described herein, provides various embodiments of a door hinge having integrated stops for providing stops when the door is opened to a predetermined angle and, thus, protecting the door and adjacent wall from being damaged.

In an embodiment, the present invention is a hinge for use with a swinging door. The hinge includes a first leaf having a first knuckle. The first knuckle defines an opening and has a detent that protrudes into the opening. The hinge also includes a second leaf which has a first knuckle which defines an opening. The second leaf first knuckle is provided with a first channel that is contiguous with the second leaf opening. A pin is also provided, which is simultaneously positionable the openings of the first and second knuckles. As such, the pin pivotly attaches the first leaf to the second leaf. The pin is provided with a first rib that is positionable within said first channel of the second leaf such that relative rotation between the pin and the second leaf is restricted by engagement of the first rib against the first channel. However, the first leaf can be rotated relative to the second leaf through a predetermined range of motion which is limited at one end of the range by the closing of the door and at the other end of its range by the engagement of the first rib against the detent.

Other additional features of the hinge include that the opening of the first leaf has a larger diameter than the opening of the second leaf. Also, the rib is unitary with the pin and the detent is unitary with the first knuckle of the first leaf. Further, the first knuckle of the second leaf includes a second channel that is contiguous with the second leaf opening and wherein the first rib is positionable within the second channel when not positioned within the first channel. Still further, the first and second channels are parallel to a longitudinal centerline, and extend the full longitudinal length, of the first knuckle opening of the second leaf. Additionally, the first and second channels are preferably radially spaced apart from each other by about 90 degrees such that the predetermined range of motion is between about 0 degrees to about 90 degrees when the first rib is positioned within the first channel and the predetermined range of motion is between about 0 degrees to about 180 degrees when the first rib is positioned within the second channel.

The pin may include a second rib that is radially spaced from said first rib. Like the first rib, the second rib is unitary in construction with the pin. In operating position, the second rib is disposed within the first knuckle opening of the first leaf. The second rib spaces the pin within the first knuckle opening of the first leaf so that the first rib is prevented from slipping over the detent when the first rib engages the detent. Moreover, the second rib is aligned with the second channel when the first rib is within the first channel.

The hinge may also be provided with a third channel that is contiguous with the second leaf opening. The second and third channels are radially spaced apart from each other by about 90 degrees. Also, the second rib is aligned with the third channel when the first rib is positioned within the second channel.

In an embodiment, the present invention is a hinge for use with a swinging door. The hinge includes a first leaf, second leaf and pin. The first leaf has first and second knuckles, each of which have an opening and a detent that protrudes into the respective opening. The detents are unitary with their respective knuckles. The second leaf has first, second and third knuckles, which each have an opening and first and second channels that are contiguous with the respective opening. The pin is simultaneously positioned in the openings of the knuckles of said first and second leafs and pivotly attaches the first and second leafs together. The pin has a first rib within the first channel of second leaf knuckles. The hinge works by having the relative rotation between the pin and second leaf restricted by engagement between the first rib and first channels and the first leaf being rotatable relative to the second leaf through a predetermined range of motion that is limited at one end by the hinge being closed and at the other end by engagement of the first rib against the detents.

The hinge may also include a second rib that, like the first rib, is unitary with the pin. The second rib is disposed within the openings of the first leaf knuckles and acts to space the pin within the first leaf knuckle openings such that the first rib is prevented from slipping over the detents. Additionally, the second leaf knuckles may include a third channel which, like the first and second channels, is parallel to a longitudinal centerline and extends the length of its respective knuckle opening. The second channels are radially spaced from their corresponding first channels by about 90 degrees, and the third channels are radially spaced from their corresponding second channels by about 90 degrees.

BRIEF DESCRIPTION OF THE DRAWINGS

The above described and other features, aspects, and advantages of the present invention are better understood when the following detailed description of the invention is read with reference to the accompanying drawings, wherein.

DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be considered as limited to the embodiments set forth herein. These exemplary embodiments are provided so that this disclosure will be both thorough and complete, and will fully convey the scope of the invention to those skilled in the art.

Referring generally to FIGS. 1-15A of the drawings, various embodiments of the invented hinge are illustrated. The invented hinge provides at least one stop at a predetermined angle of the door being opened in order to restrict the door from striking an adjacent wall. The hinge may be adjusted in order to provide an alternative stop angle. Typically, these stops correlate to the door being opened to about 90 degrees or about 180 degrees, although the hinge may be manufactured to provide a stop at any desired swing angle.

Figure 1:
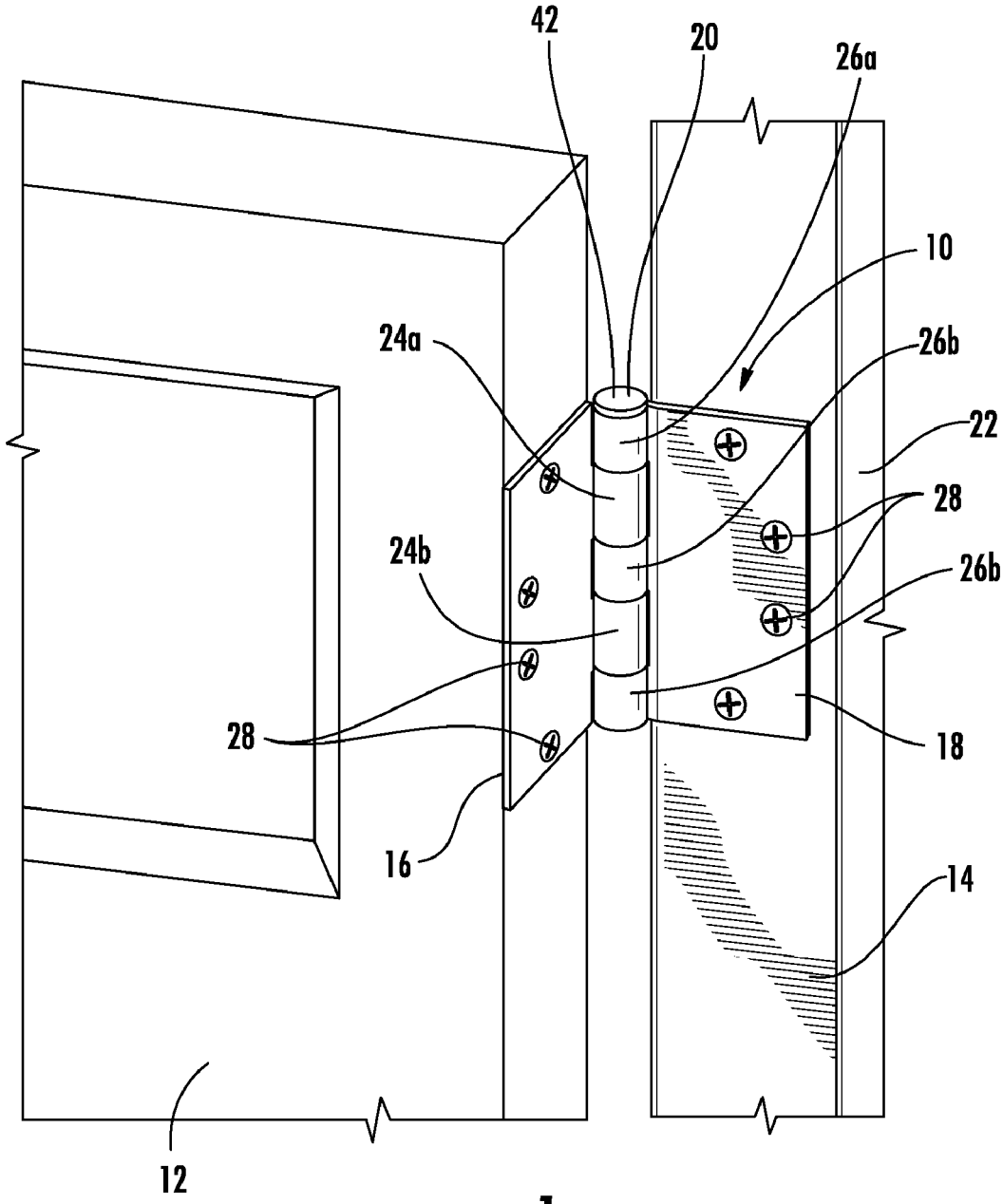
FIG. 1 is a perspective view of the invented door hinge having integrated stops, in operating position attached to a door and door jam, in accordance with an embodiment of the present invention.

Referring to FIG. 1, the invented hinge 10 is shown in operating position securing a swinging door 12 to a door jam 14. The hinge 10 has the appearance of an ordinary door hinge and requires only three parts (i.e. leafs 16, 18 and pin 20) to properly operate and stop the door 14 from opening beyond a predetermined angle so to eliminate any risk of damage that could otherwise occur if the door 14 engaged against an adjacent wall 22.

The hinge 10 includes a first leaf 16 having at least one knuckle (two knuckles 24*a*, 24*b* are illustrated), a second leaf 18 having at least one knuckle (three knuckles 26*a*, 26*b* are illustrated), and the pin 20. The first leaf 12 is conventionally mounted to the door 14 and the second leaf to the door jam 14 by, for example, securing the illustrated screws 28 through openings 27 in the leafs 16, 18. The pin 20 pivotally secures the leafs 16, 18 together and, thus, hingedly attaches to door 12 to the door jam 14.

Figure 2:
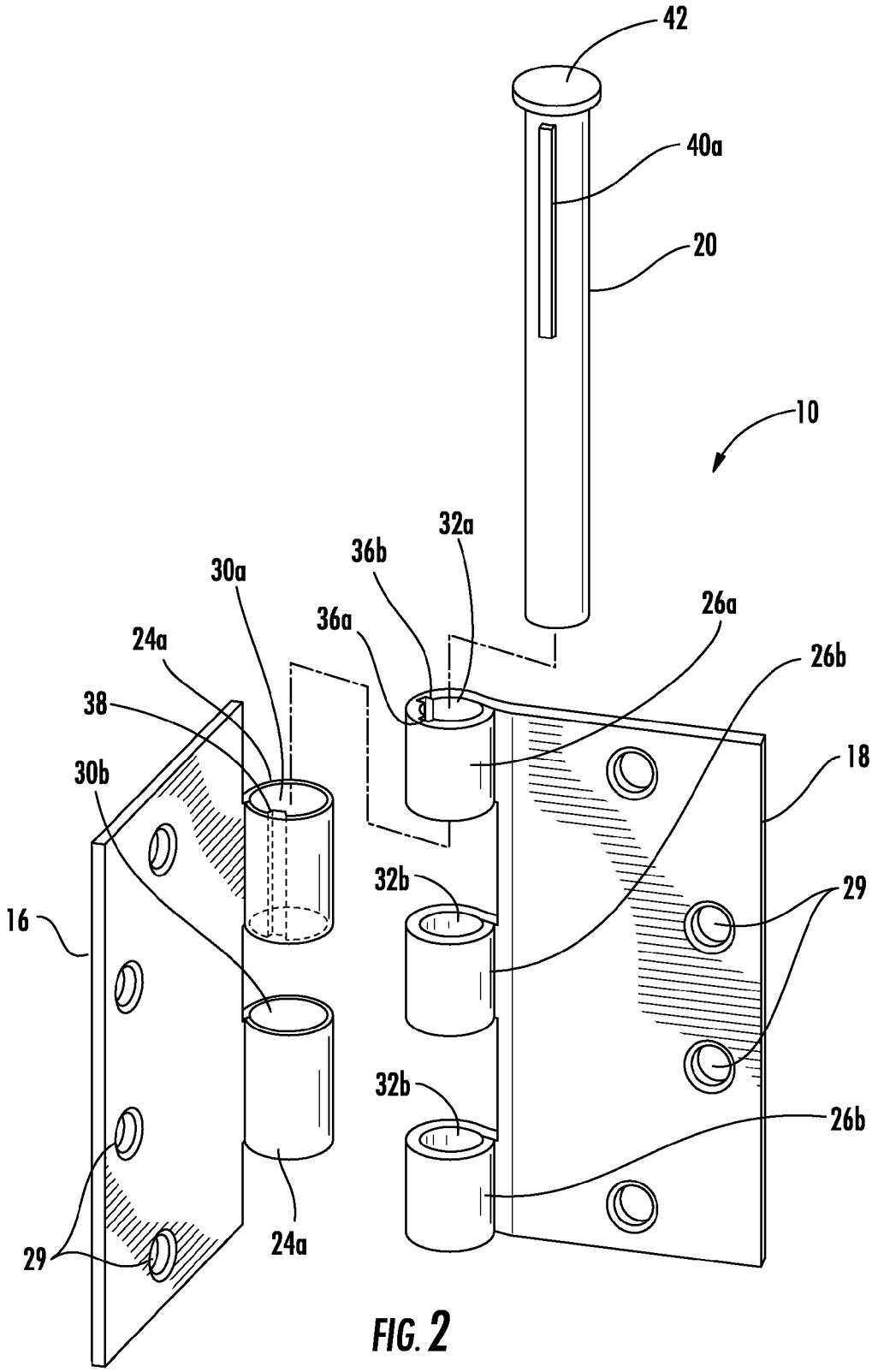
FIG. 2 is an exploded view of the door hinge of FIG. 1, without the surrounding environment, further showing the details of the pin and knuckles of the hinge.
Figure 3A:
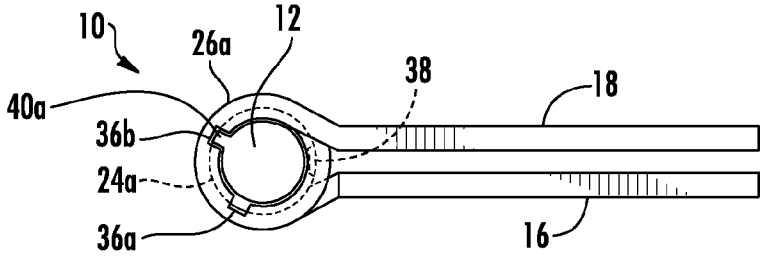
FIG. 3A is a top view of the door hinge of FIG. 1, without depicting the surrounding environment or head of the pin for the purpose of clarity, showing the hinge in a closed position and wherein the pin communicates with the knuckles thereby limiting the range of door movement from about 0 to 180 degrees.
Figure 3B:
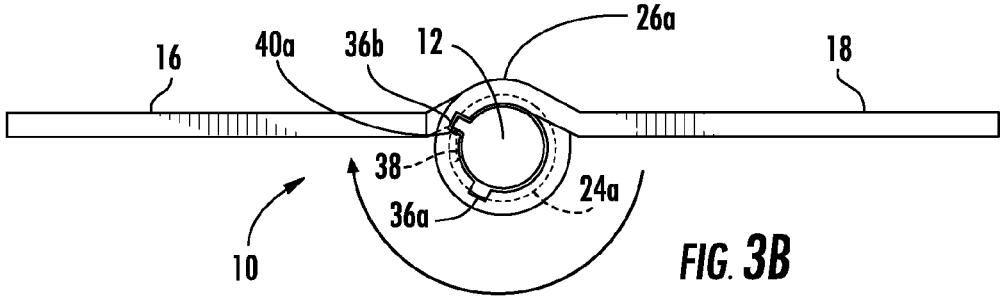
FIG. 3B is a top view of the door hinge of FIG. 1, without depicting the surrounding environment or head of the pin for the purpose of clarity, showing the hinge in an open position and wherein the pin communicates with the knuckles thereby limiting the range of door movement from about 0 to 180 degrees.

In the preferred embodiment, the first leaf 16 has two spaced apart knuckles 24*a*, 24*b* and the second leaf 18 has three spaced apart knuckles 26*a*, 26*b*, as illustrated in FIGS. 1 and 2. The knuckles 24, 26 are spaced so that the two knuckles 24*a*, 24*b* of the first leaf 18 are intermittently disposed between the three knuckles 26*a*, 26*b* of the second leaf 18 when the leafs 16, 18 are positioned together in operating position.

Each of the knuckles 24*a*, 24*b*, 26*a*, 26*b* have an opening 30*a*, 30*b*, 32*a*, 32*b*. These openings 30*a*, 30*b*, 32*a*, 32*b* are generally coaxial so that the pin 20 may be simultaneously disposed within each of the openings 30*a*, 30*b*, 32*a*, 32*b*, thereby pivotally securing the leafs 16, 18 together.

Referring to FIGS. 2-4B, the uppermost openings 30*a* of the first leaf 16 has a larger diameter than the uppermost opening 32*a* of the second leaf 18 such that the first leaf 16 can rotate relative to the pin 20 whereas the second leaf 18 cannot rotate relative to the pin 20, as described below in greater detail. (Regarding FIGS. 3A-4B, the head of the pin 20 is not shown for the purpose of clarity).

As illustrated in FIGS. 2-4B, regarding the second leaf 18, the opening 32*a* of the first knuckle 26*a* is provided with at least one channel (two channels 36*a*, 36*b* are illustrated) that is parallel to the centerline of the knuckle opening 32*a* and ideally extends the full longitudinal length of the first knuckle 24*a*. The first channel 36*a* corresponds to a stop point of when the door is opened to about 90 degrees. The second channel 36*b* corresponds to a stop point of when the door is opened to about 180 degrees. As such, in the preferred embodiment the first and second channels 36*a*, 36*b* are radially spaced from each other by about 90 degrees. It is to be understood that it is within the scope of the present invention to include other channels which correspond to stop points at different degrees of door openings, or having only one channel to provide only one predetermined stop point, or the similar variations.

Regarding the first leaf 16, the first knuckle 24*a* includes a detent 38 that protrudes into the knuckle opening 30*a*. Referring to FIGS. 2-5A, the detent 38, in cooperation with the pin 20, define a stop point for the door 12. Although not required, preferably the detent 38 extends the full longitudinal length of the first knuckle 24 and is integral (i.e. unitary) with the first knuckle 24 in order to provide significant structural integrity when stopping the door 12 for swinging further open. Accordingly, the detent 38 is not removable from the first leaf 16.

Referring to FIGS. 2-4B, the pin 20 includes a rib 40*a*. In the preferred embodiment, the rib 40*a* is elongate, having a height and width that correspond to the size of the channels 36*a*, 36*b* and a length sufficient for the rib 40*a* to be within one of the channels 36*a*, 36*b* and engage the detent 38 simultaneously. Notwithstanding, it is to be understood that other shapes for the rib 40*a* may be used so long as the rib 41*a* serves to eliminate relative rotation between the second leaf 18 and pin 20, and allows a range of relative rotation between the first and second leaf 16, 18 up to engagement with the detent 38. For example, the rib 40*a* be segmented along its length (not illustrated). The rib 40*a* is integral with the pin 20. That is, the rib 40*a* and pin 20 are of a singular unitary construction in order to limit the number of parts, simplify construction and improve structural integrity. For example, the rib 40*a* and pin 20 may be formed as a single piece or made unitary by being welded together. As such, the rib 40*a* is not removable from the second leaf 18.

The diameter of the first opening 32*a* of the second leaf 18 is slightly larger than the diameter of the pin 20 whereby the pin 20 may can slide into the opening 32*a* but the outwardly directed rib 40*a* necessarily extends beyond the opening 32*a* into one of the channels 36*a*, 36*b*. Accordingly, the second leaf 18 cannot rotate relative to the pin 20.

In contrast, the diameter of the first opening 30*a* of the first leaf 16 is larger than that of the first opening 32*a* of the second leaf 18. The first leaf opening 30*a* is sized such that the uppermost knuckle 24*a* (and i.e. the first leaf 16) may rotate relative to the pin 20 up to engagement between the rib 40*a* and detent 38. In the preferred embodiment, the first leaf opening 30*a* is about ⅛ inch larger than the second leaf opening 32*a*.

Figure 4A:
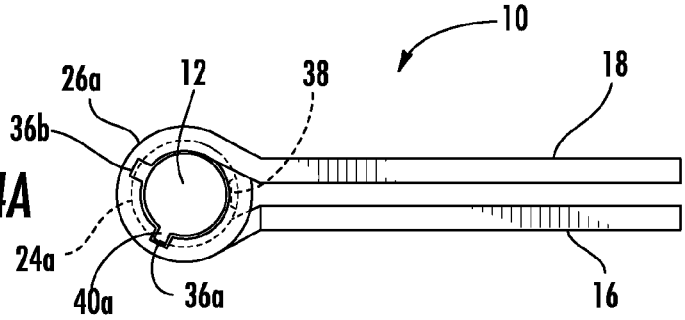
FIG. 4A is a top view of the door hinge of FIG. 1, without depicting the surrounding environment or head of the pin for the purpose of clarity, showing the hinge in a closed position and wherein the pin communicates with the knuckles thereby limiting the range of door movement from about 0 to 90 degrees.
Figure 4B:
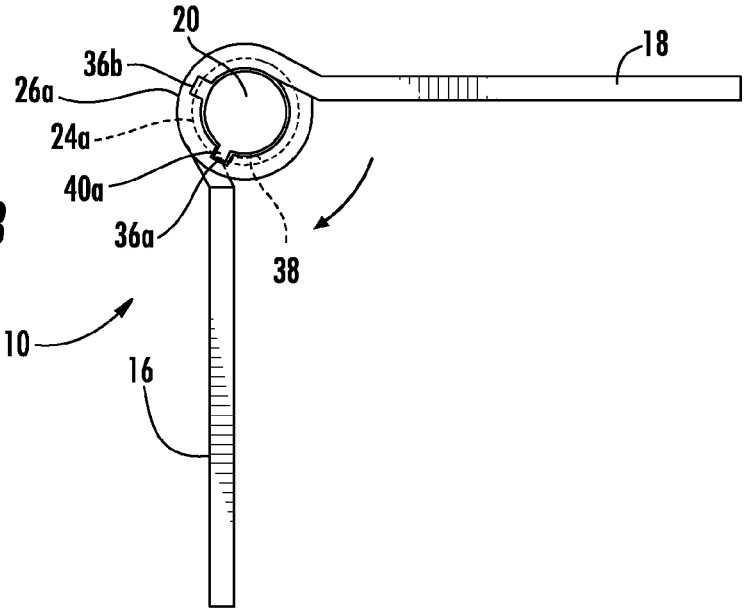
FIG. 4B is a top view of the door hinge of FIG. 1, without depicting the surrounding environment or head of the pin for the purpose of clarity, showing the hinge in an open position and wherein the pin communicates with the knuckles thereby limiting the range of door movement from about 0 to 90 degrees.
Figure 5:
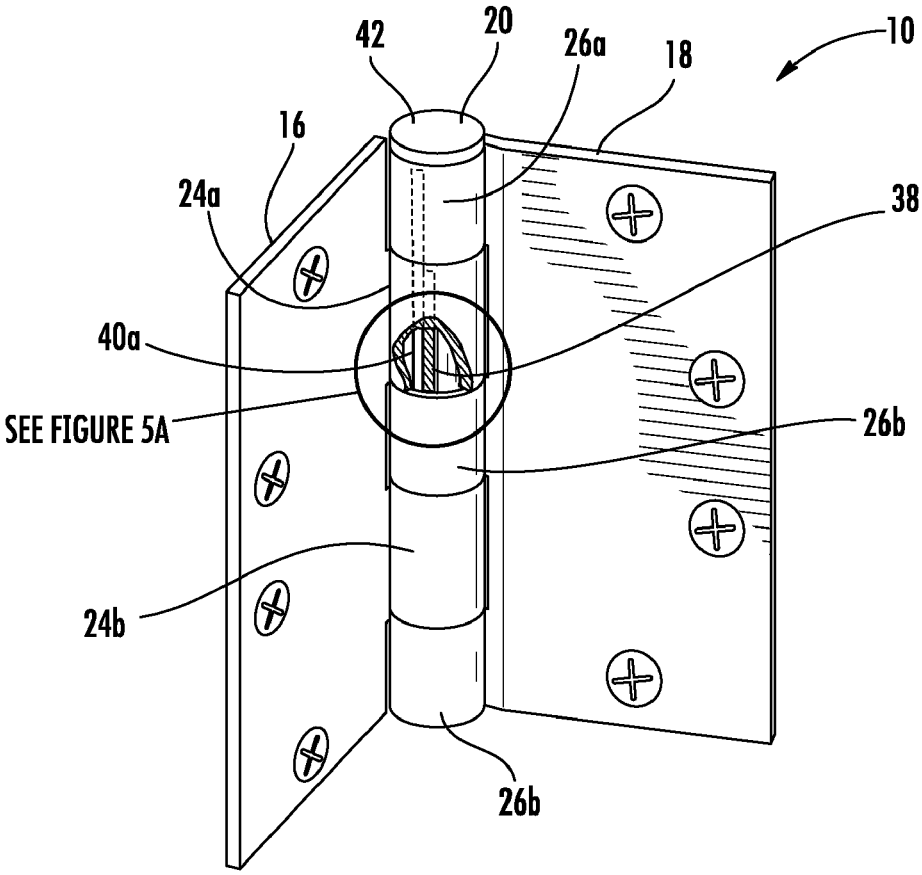
FIG. 5 is a cut-away view of the hinge of FIG. 1, showing a rib of the pin engaged against a detent of the first leaf thereby stopping the door at a predetermined angle from opening further.
Figure 5A:
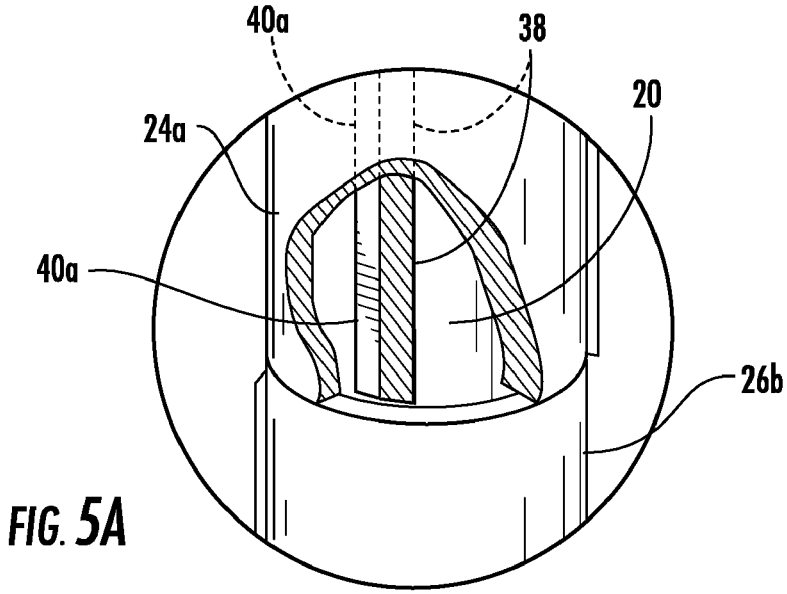
FIG. 5A is a detail view of the hinge of FIG. 5.

Referring to FIG. 1, in use, the first and second leafs 16, 18 are conventionally mounted via screws 28 to the door 12 and door jam 14, respectively. The knuckles 24*a*, 24*b*, 26*a*, 26*b* are positioned so that their openings 30*a*, 30*b*, 32*a*, 32*b* (see FIG. 2) are coaxially aligned. Referring to FIGS. 2-4B, the pin 20 is then inserted into the openings 30*a*, 30*b*, 32*a*, 32*b* with the rib 40*a* positioned into the channel (36*a* or 36*b*) which correlates to the desired range of opening for the door 12 (e.g. about 0 to about 90 degrees of opening for channel 36*a* as shown in FIG. 4B, or about 0 to about 180 degrees of opening for channel 36*b* as shown in FIG. 4B).

Referring FIGS. 2-5A, as the door 12 is being opened, the first leaf 16 is rotated about the pin 20 until the rib 40*a* engages the detent 38, causing the door 12 to stop. More specifically, since the rib 40*a* is disposed within the selected channel (36*a* or 36*b*), the pin 20 is fixed in relation to the second leaf 18. And, as the first opening 30*a* of the first leaf 16 has a sufficient diameter so that the first knuckle 24*a* rotates about the pin 20, the first leaf rotates about the pin 20 until the rib 40*a* engages the detent 38 at which point the door 12 is stopped for being further opened. As it will be understood by those skilled in the art, it is the combined positioning of the rib 40*a* and detent 38 that provides the predetermined swing range of the door 12.

To change the range of door movement, e.g. about 0 to about 180 degrees instead of about 0 to about 90 degrees, the pin 20 may be removed by use of a screw driver driving upwards against a head 42 of the pin 20 until the pin 20 is fully released from the knuckles 24*a*, 24*b*, 26*a*, 26*b*. Thereafter, the pin 20 is reinserted into the knuckles 24*a*, 24*b*, 26*a*, 26*b*, but with the rib 40*a* now being positioned into the newly chosen channel (36*a* or 36*b*) which correlates to the desired swing range for the door 12.

Figure 6:
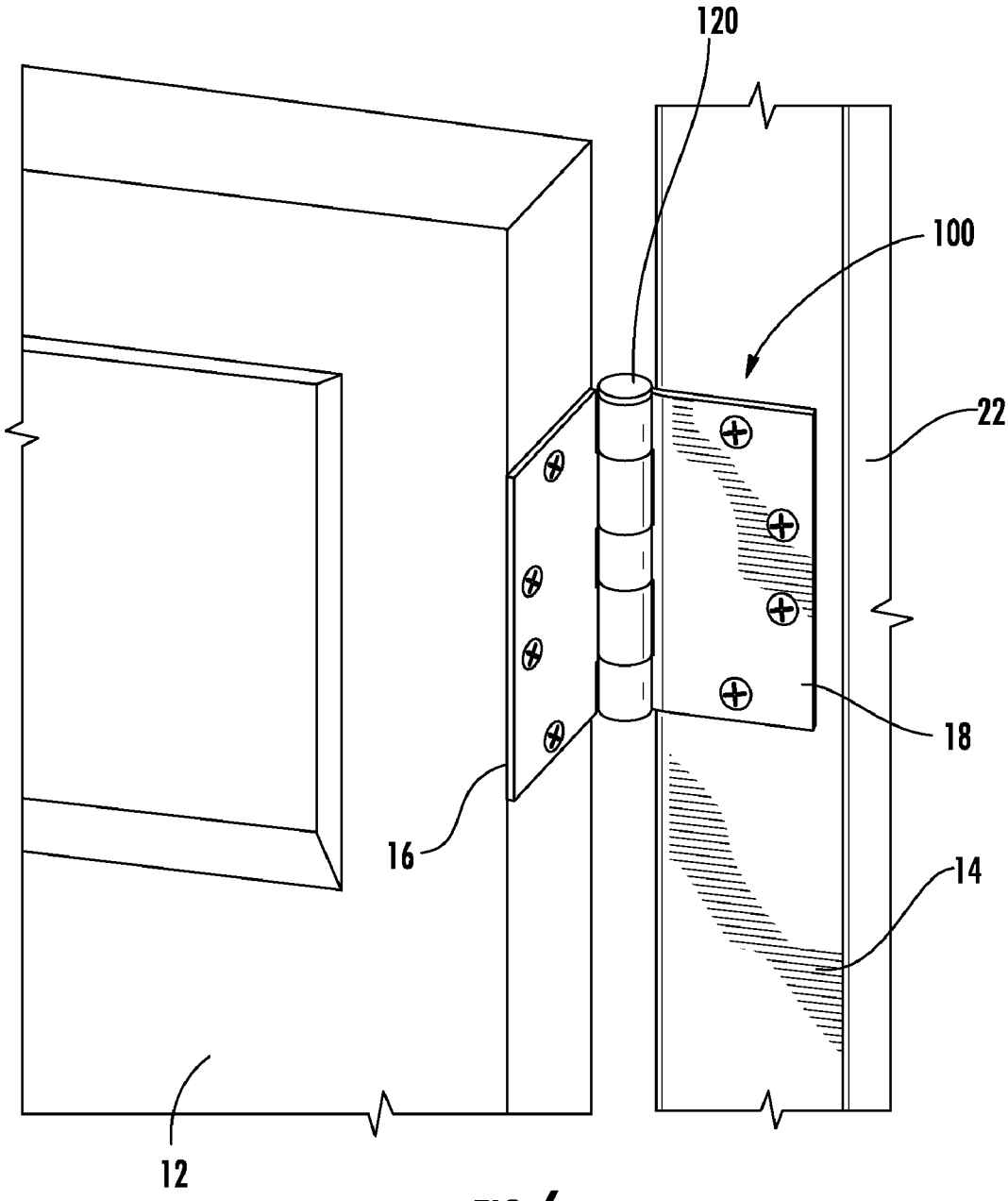
FIG. 6 is a perspective view of the door hinge having integrated stops, in operating position attached to a door and door jam, in accordance with an alternative embodiment of the present invention.
Figure 7:
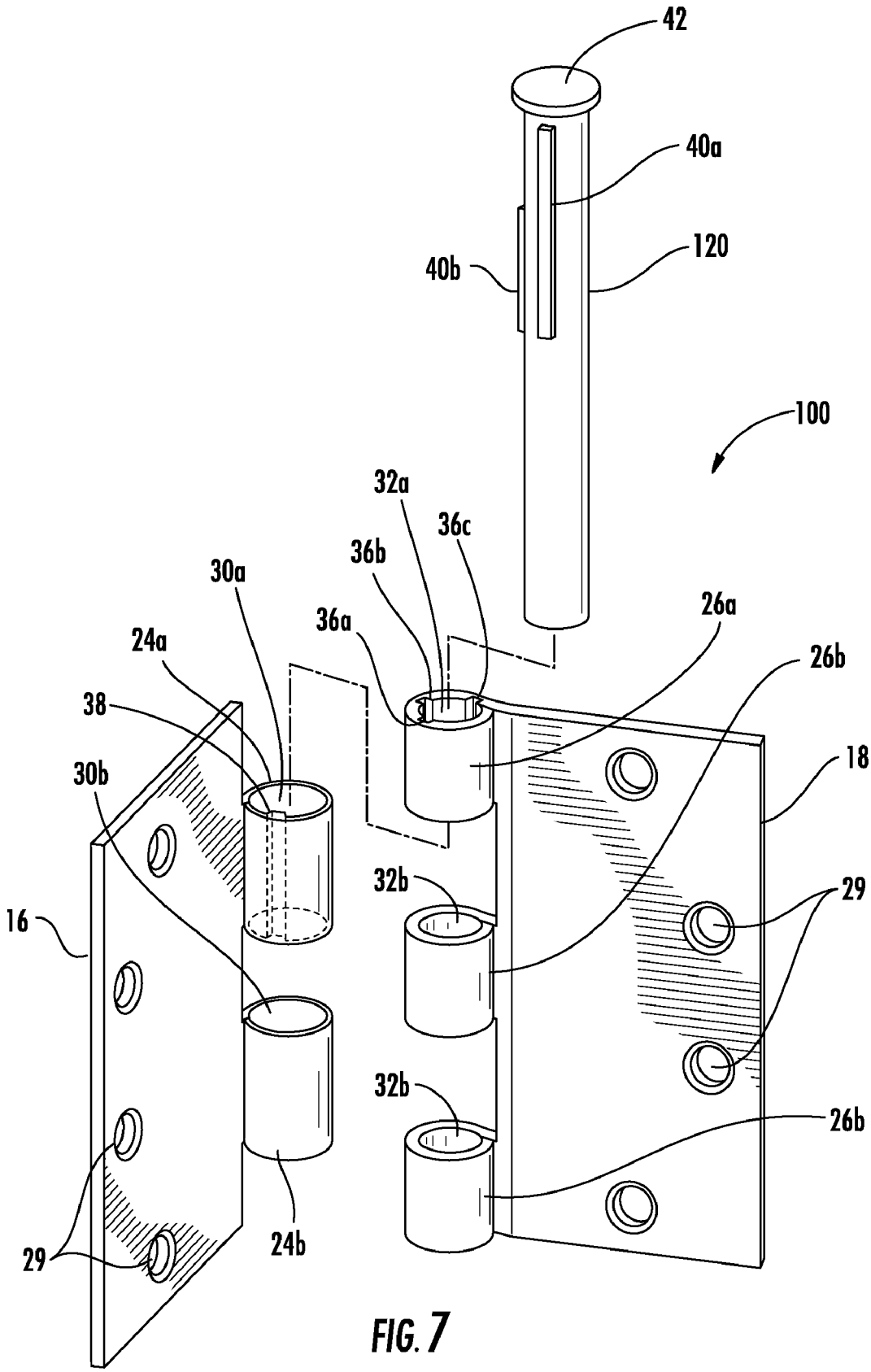
FIG. 7 is an exploded view of the alternative embodiment of the invented door hinge of FIG. 6, showing a pin having two ribs and the details of the pin and knuckles of the hinge, in accordance with the present invention.
Figure 8A:
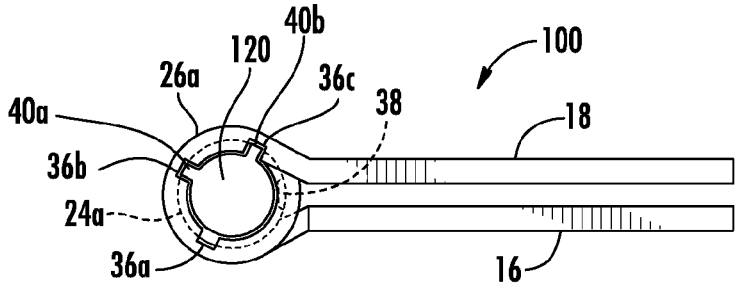
FIG. 8A is a top view of the door hinge of FIG. 6, without depicting the surrounding environment or head of the pin for the purpose of clarity, showing the hinge in a closed position and wherein the pin communicates with the knuckles thereby limiting the range of door movement from about 0 to 180 degrees.
Figure 8B:
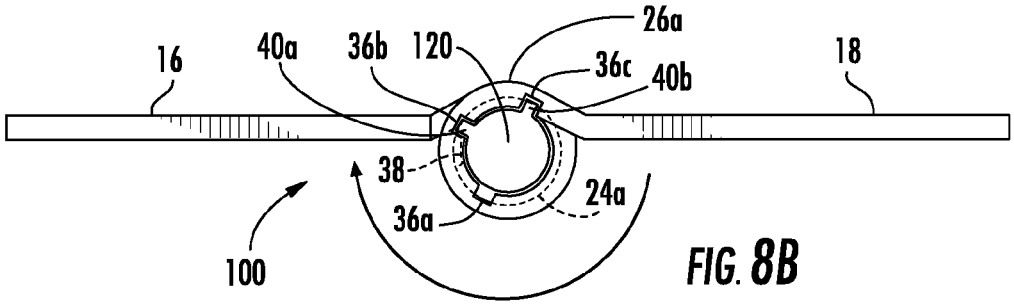
FIG. 8B is a top view of the door hinge of FIG. 6, without depicting the surrounding environment or head of the pin for the purpose of clarity, showing the hinge in an open position and wherein the pin communicates with the knuckles thereby limiting the range of door movement from about 0 to 180 degrees.
Figure 9A:
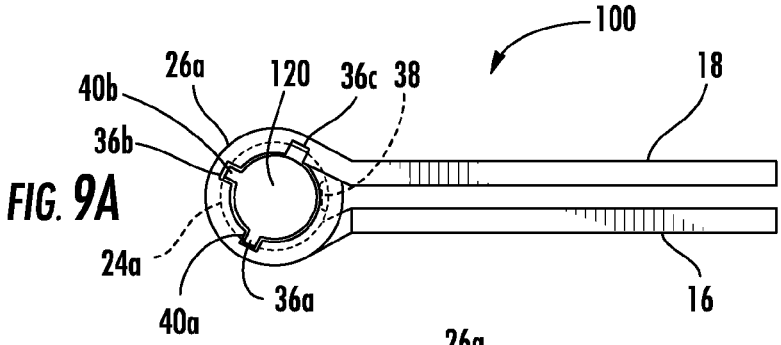
FIG. 9A is a top view of the door hinge of FIG. 6, without depicting the surrounding environment or head of the pin for the purpose of clarity, showing the hinge in a closed position and wherein the pin communicates with the knuckles thereby limiting the range of door movement from about 0 to 90 degrees.
Figure 9B:
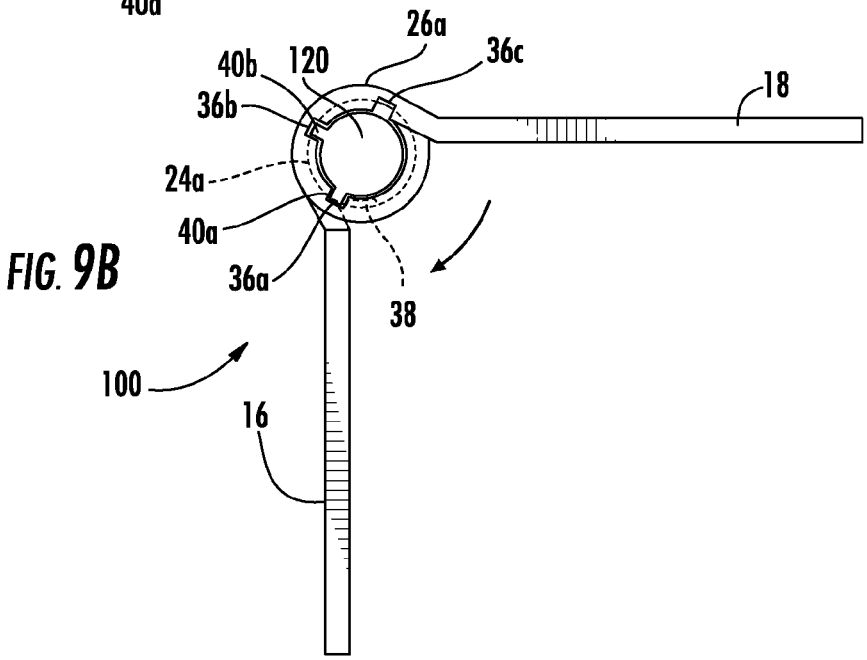
FIG. 9B is a top view of the door hinge of FIG. 6, without depicting the surrounding environment or head of the pin for the purpose of clarity, showing the hinge in an open position and wherein the pin communicates with the knuckles thereby limiting the range of door movement from about 0 to 90 degrees.
Figure 10:
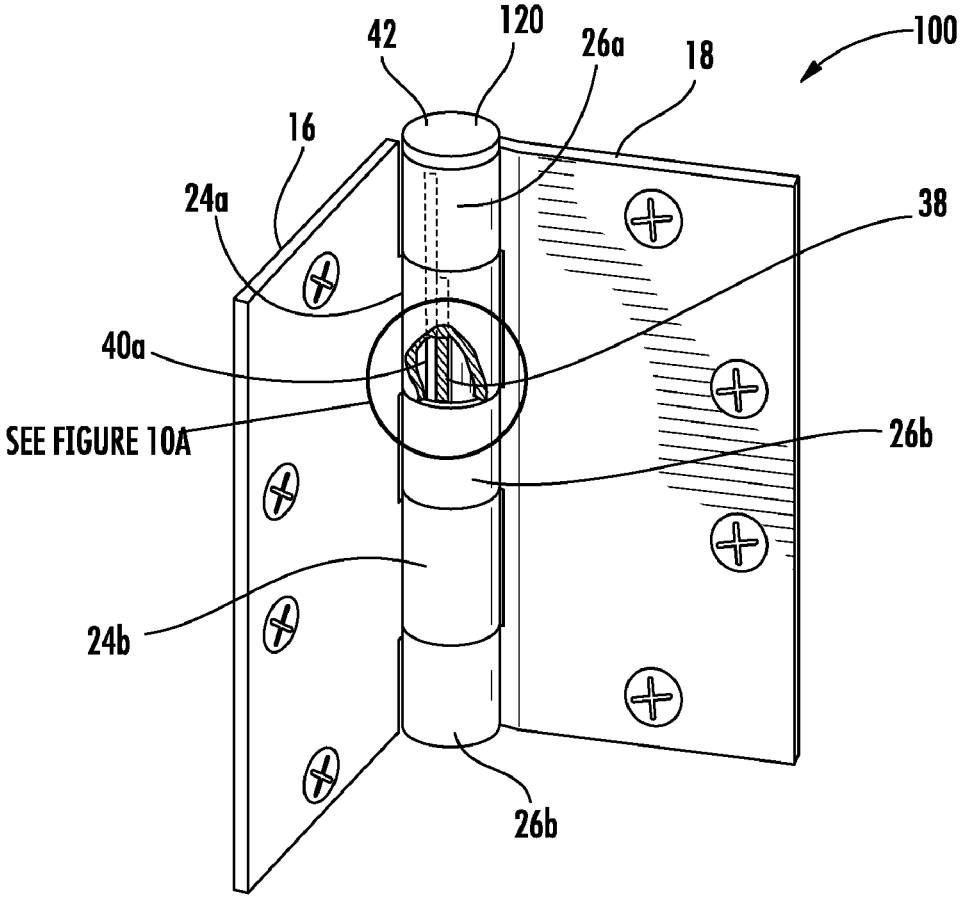
FIG. 10 is a cut-away view of the hinge of FIG. 6, showing a rib of the pin engaged against a detent of the first leaf thereby stopping the door at a predetermined angle from opening further.
Figure 10A:
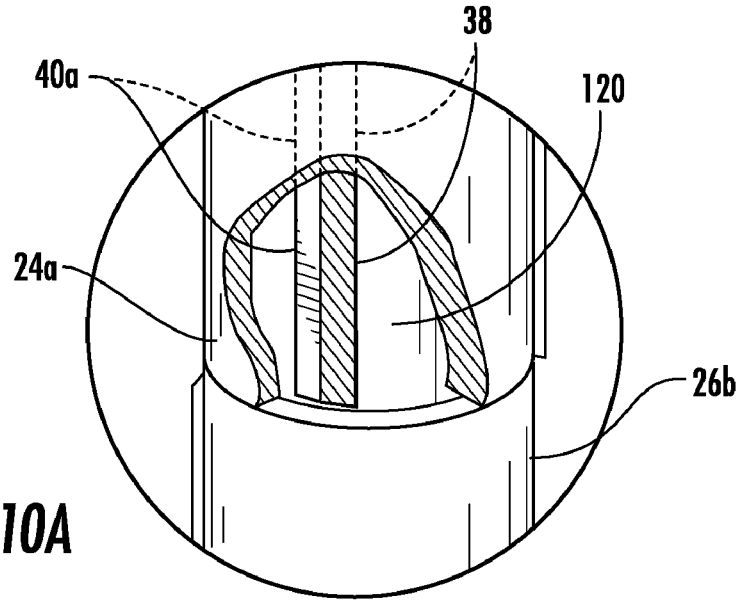
FIG. 10A is a detail view of the hinge of FIG. 10.
Figure 11:
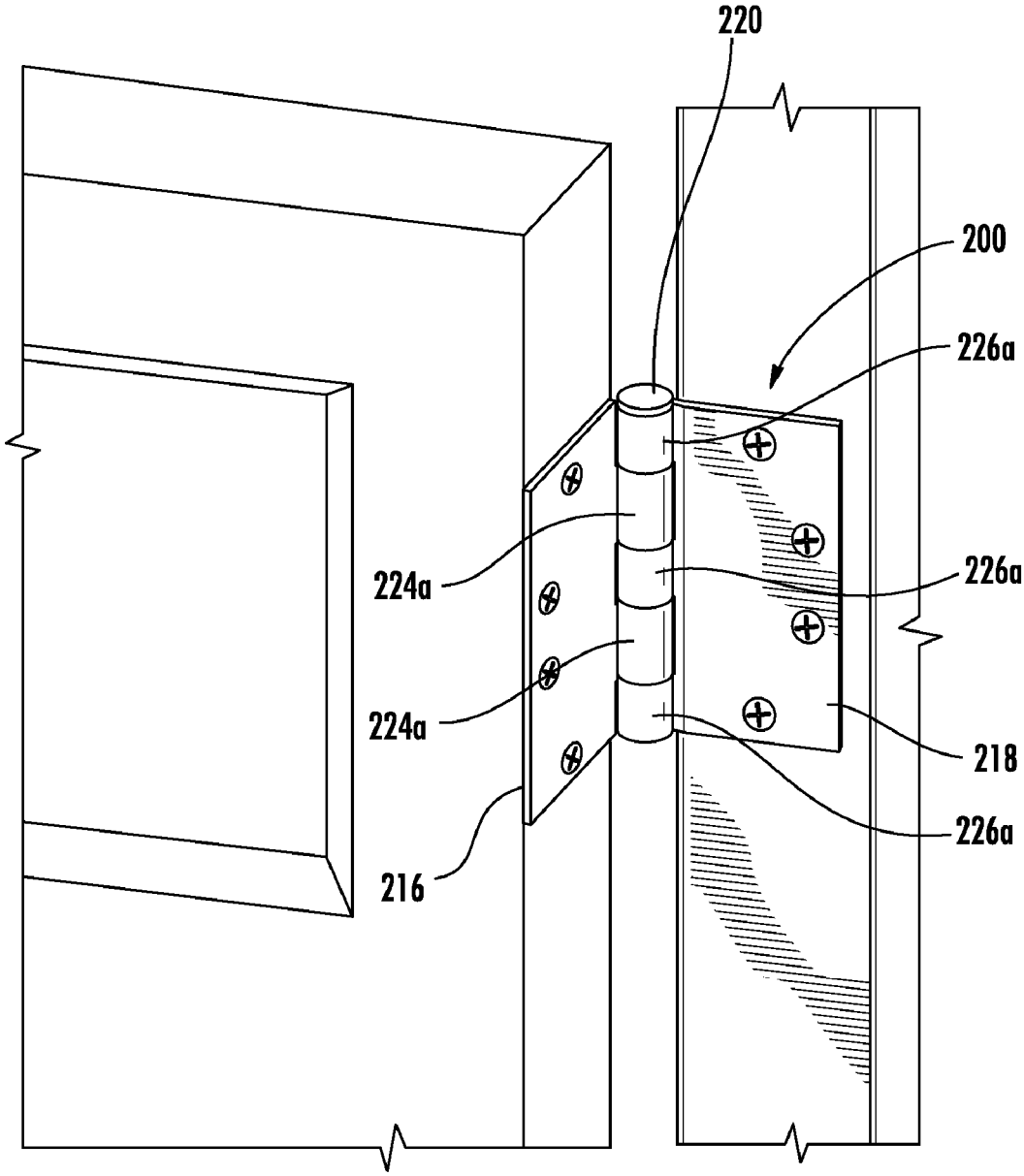
FIG. 11 is a perspective view of the door hinge having integrated stops, in operating position attached to a door and door jam, in accordance with an alternative embodiment of the present invention.
Figure 12:
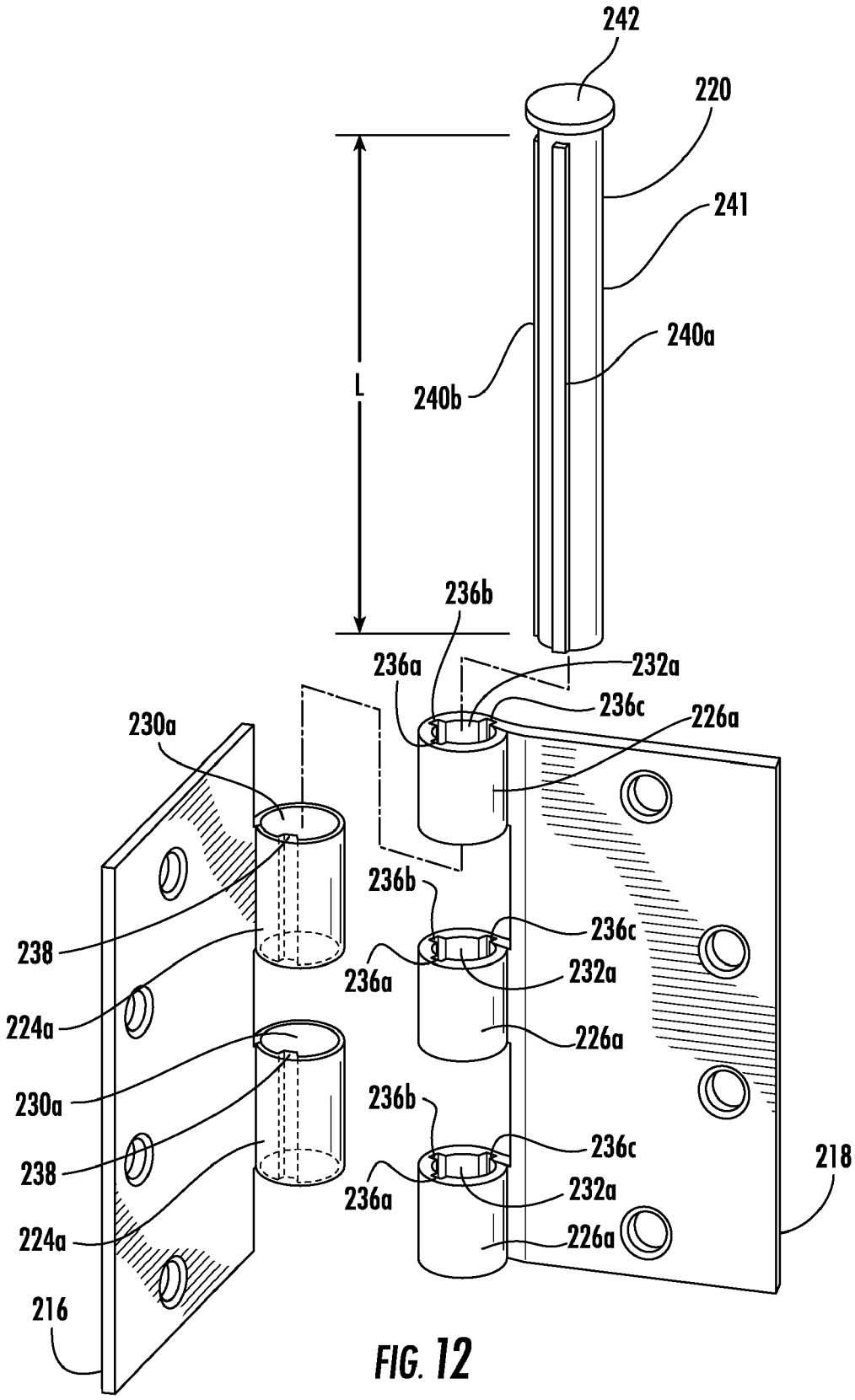
FIG. 12 is an exploded view of the alternative embodiment of the invented door hinge of FIG. 11, showing a pin having two ribs and the positioning of the pin in relation to the knuckles of the hinge, in accordance with the present invention.
Figure 13A:
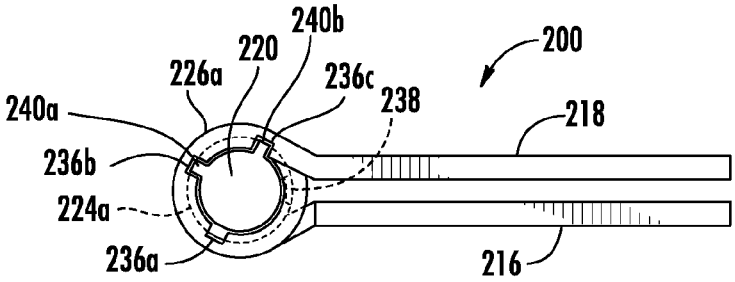
FIG. 13A is a top view of the door hinge of FIG. 11, without depicting the surrounding environment or head of the pin for the purpose of clarity, showing the hinge in a closed position and wherein the pin communicates with the knuckles thereby limiting the range of door movement from about 0 to 180 degrees.
Figure 13B:
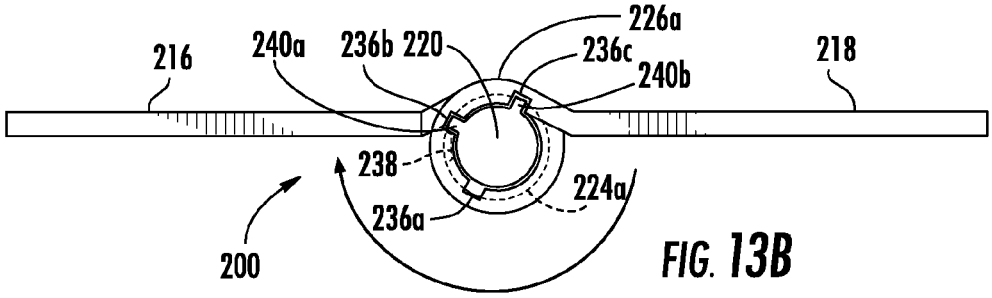
FIG. 13B is a top view of the door hinge of FIG. 11, without depicting the surrounding environment or head of the pin for the purpose of clarity, showing the hinge in an open position and wherein the pin communicates with the knuckles thereby limiting the range of door movement from about 0 to 180 degrees.
Figure 14A:
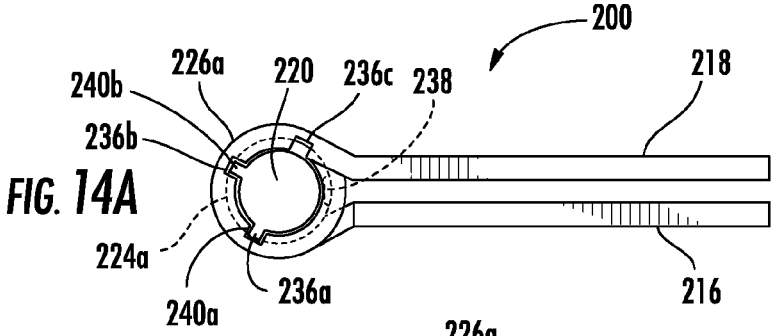
FIG. 14A is a top view of the door hinge of FIG. 11, without depicting the surrounding environment or head of the pin for the purpose of clarity, showing the hinge in a closed position and wherein the pin communicates with the knuckles thereby limiting the range of door movement from about 0 to 90 degrees.
Figure 14B:
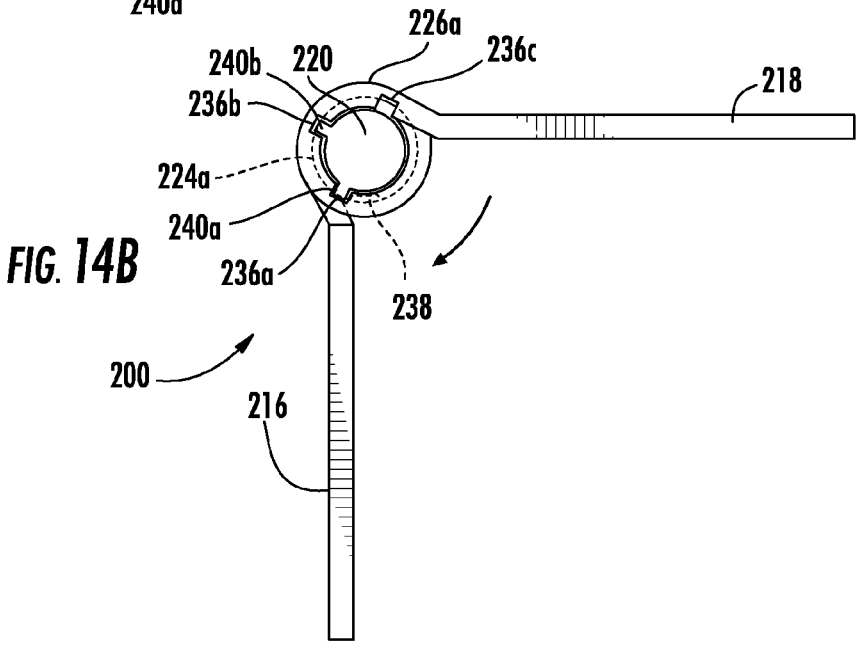
FIG. 14B is a top view of the door hinge of FIG. 11, without depicting the surrounding environment or head of the pin for the purpose of clarity, showing the hinge in an open position and wherein the pin communicates with the knuckles thereby limiting the range of door movement from about 0 to 90 degrees.
Figure 15:
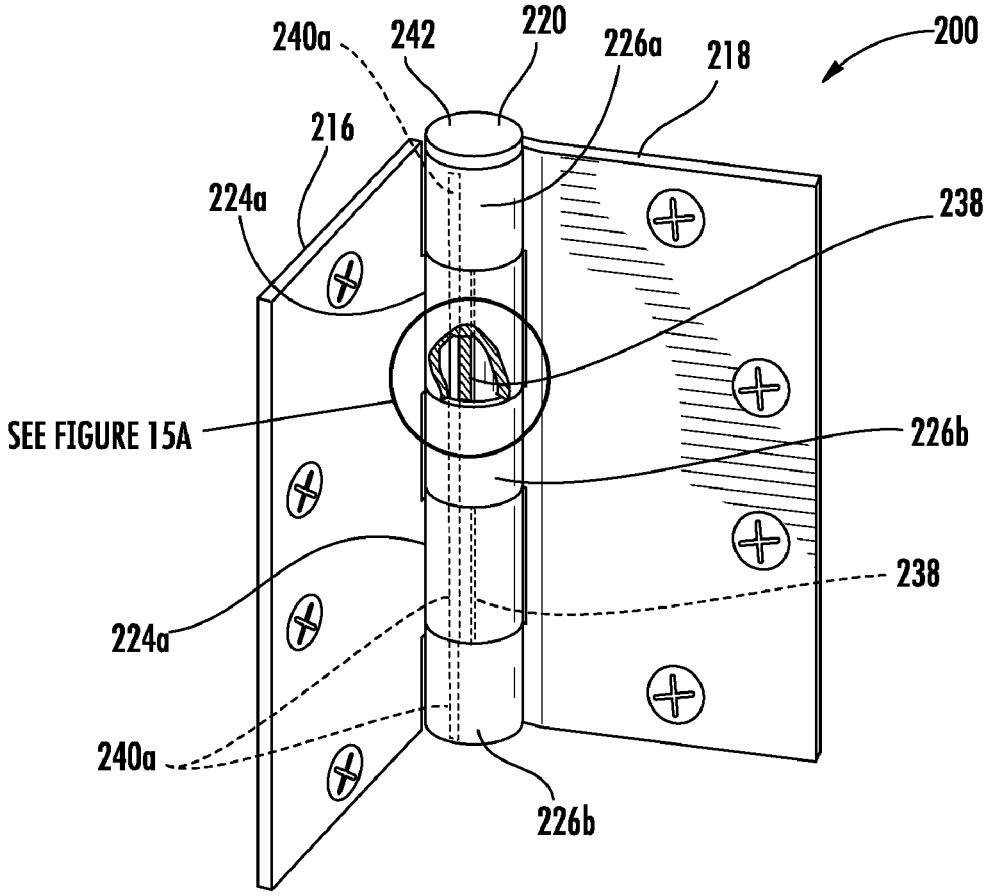
FIG. 15 is a cut-away view of the hinge of FIG. 11, showing a rib of the pin engaged against a detent of the first leaf thereby stopping the door at a predetermined angle from opening further.
Figure 15A:
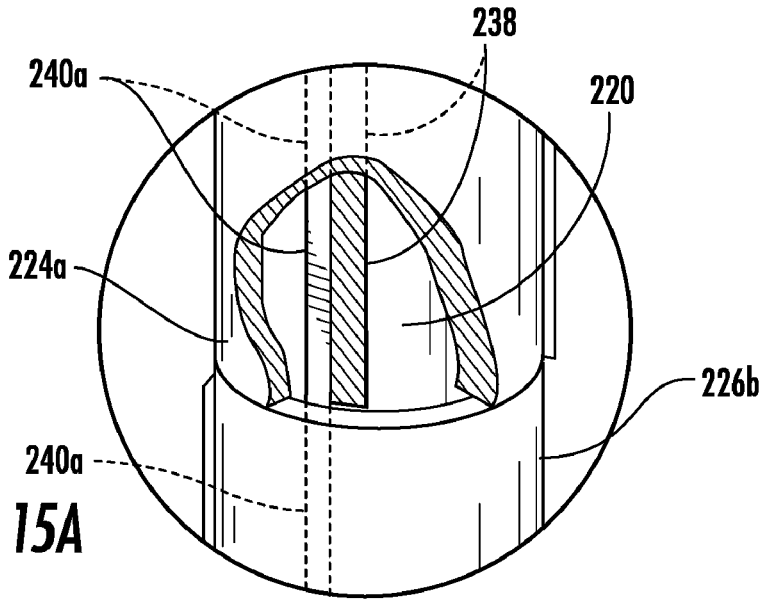
FIG. 15A is a detail view of the hinge of FIG. 15.

Referring to FIGS. 6-10A, in an alternative embodiment of the invention, the hinge 100 has first and second leafs 16, 18 and a pin 120. The first leaf 16 has the same configuration as described in relation to FIGS. 1-5 and, thus, said description is incorporated herein. Also, notwithstanding that FIG. 6 depicts a third channel 36*c* in the first knuckle 12*a*, the second leaf 18 has the same configuration as that described in relation to FIGS. 1-5 and, thus, said description is incorporated herein. As with the first and second channels 36*a*, 36*b*, the third channel 36*c* is parallel to the centerline of the knuckle opening 32*a* and extends the full longitudinal length of the first knuckle 24*a*. Preferably, the first, second and third channels 36*a*, 36*b*, 36*c* are respectively spaced apart by about ninety degrees. Further, the pin 120 is the same as described in relation to FIGS. 1-5, but further includes a second rib 40*b*. As such, the above descriptions of the pin 20 and rib 40*a* are incorporated into this alternative embodiment. Like reference numbers in FIGS. 6-10A as compared to reference numbers in FIGS. 1-5A refer to like elements.

The second rib 40*b* functions as a spacer in order to keep the first rib 40*a* from being forced up and over the detent 38, during door 12 stoppage, by limiting movement of the pin 120 away from the detent 38.

In the preferred embodiment, the second rib 40*b* is elongate, having a height and width that allows from the rib 40*b* to be passed through the channels 36*b*, 36*c*, although it is to be understood other shapes for the rib 40*b* may also be suitable. The rib 40*b* is provided on the pin 120 such that it is disposed within the first knuckle opening 30*a* of the first leaf 16 when the hinge 100 is in operating condition.

The second rib 40*b* may have a variety of lengths. For example, the rib 40*b* may have a length that is about the same as the height of the first knuckle 30*a* (as illustrated in FIG. 6), or a length that is about the combined height of the first knuckles 30*a*, 32*a*, or any other suitable shape and size provided that the second rib 40*b* acts as a spacer within the first knuckle opening 30*a* of the first leaf 16. The second rib 40*b* is integral with the pin 20. That is, the second rib 40*b* and pin 20 are of a singular unitary construction in order to limit the number of parts, simplify construction and improve structural integrity. For example, the second rib 40*b* and pin 20 may be formed as a single piece or made unitary by being welded together.

The second rib 40*b* is radially spaced from the first rib 40*a* so that when the first rib 40*a* is positioned in the first channel 36*a*, then the second rib 40*b* is aligned with the second channel 36*b*. And, when the first rib 40*a* is positioned in the second channel 36*b*, then the second rib 40*b* is aligned with the third channel 36*c*. Thus, in the preferred embodiment, the first and second channels 36*a*, 36*b* are spaced apart by 90 degrees and, likewise, the first and second ribs 40*a*, 40*b* are spaced apart by about 90 degrees. It is to be understood that it is within the scope of the present invention to include other channels which correspond to stop points at different degrees of door openings, having only two channels to have only one predetermined stop point, or other variations. And accordingly, the spacing between the first and second ribs will need to coincide with any new spacing of the channels.

In use, the pin 120 is inserted into the openings 30*a*, 30*b*, 32*a*, 32*b* with the first rib 40*a* positioned into the channel (36*a* or 36*b*) which relates to the desired range of opening for the door 12 (i.e. about 0 to about 90 degrees of opening for channel 36*a*, and about 0 to about 180 degrees of opening for channel 36*b*). When the pin 120 is being inserted, the second rib 40*b* is passed through the channel (36*b* or 36*c*) subsequent from the channel (36*a* or 36*b*) in which the first rib 40*a* is disposed. That is, if the first rib 40*a* is positioned in the first channel 36*a*, then the second rib 40*b* passes through the second channel 36*b*. And likewise, if the first rib 40*a* is positioned in the second channel 36*b*, then the second rib 40*b* is passed through the third channel 36*c*.

Once the pin is fully positioned into the knuckles 24*a*, 24*b*, 26*a*, 26*b*, the first rib 40*a* is positioned in the desired channel (36*a* or 36*b*) and extends into the first opening 30*a* of the first knuckle 24*a*. Since the first rib 40*a* is disposed within the selected channel 36*a*, 36*b*, the pin 120 is fixed in relation with the second leaf 18.

As the door 12 is being opened, the first leaf 16 rotates about the pin 120 until the first rib 40*a* engages the detent 38, causing the door 12 to stop at a predetermined angle. Should the first rib 40*a* seek to slip over the detent 38, movement of the pin 120 away from the detent 38 is restricted by the second rib 40*b* acting as a spacer by engaging against the interior surface of the first knuckle 24*a*. As it will be understood by those skilled in the art, it is the combination of the rib 40*a* and detent 38 positions that provides the predetermined swing range for the door 12.

To change the range of door movement, e.g. 0 to 180 degrees instead of 0 to 90 degrees, the pin 20 may be removed by use of a screw driver driving upward against a head 42 of the pin 20 until the pin 20 is fully released from the knuckles 24*a*, 24*b*, 26*a*, 26*b*. Thereafter, the pin 20 is reinserted into the knuckles 24*a*, 24*b*, 26*a*, 26*b*, but with the first rib 40*a* now being positioned into the newly chosen channel (e.g. 36*b*) and the second rib 40*b* inserted through the succeeding channel (e.g. 36*c*).

It is to be understood that various modifications to the invented hinge are also within the scope of this invention. For example, the aforementioned described embodiments may be modified such that channel(s) are provided through all of the knuckles of the second leaf, a detent is provided on all of the knuckles of the first leaf, and the rib(s) extended to the end of the pin in order to provide even greater structurally integrity against acting forces during stoppage of the door. An example of such an alternative embodiment is illustrated in FIGS. 11-15A.

Referring to FIGS. 11-15A, the invented hinge 200 has first and second leafs 216, 218 (including openings 230*a*, 232*a*) and pin 220 as described in relation to the first and second leafs 16, 18 (including openings 30*a*, 32*b*) and pin 120 of FIGS. 6-10A, and thus said description is incorporated herein, except that each knuckle 226*a* of the second leaf 218 is provided with channels 236*a*, 236*b*, 236*c*, each knuckle 224*a* of the first leaf 216 is provided with a detent 238, and the pin 220 includes first and second ribs 240*a*, 240*b* that extend about the full length (L) of the pin shaft 241 (i.e. excluding the head 242), as illustrated in FIGS. 12-15A.

By having the first and second ribs 240*a*, 240*b* extend about the length (L) of the pin shaft 241, the first rib 240*a* is positioned within the channel (236*a* or 236*b*) of each second leaf knuckle 226*a*, thereby providing greater structural integrity in restricting relative rotation between the second leaf 218 and pin 220 than that of the embodiment of FIGS. 6-10A. And, the first rib 240*a* is positioned within each first leaf knuckles 224*a* whereat it engages each of the first leaf detents 238 to restrict a door from further opening once it has reached its predetermined swing angle. Accordingly, greater stopping integrity is provided than that of the embodiment of FIGS. 6-10A. Further, the increased length of the second rib 240*a* provides additional contact areas for spacing the pin 220. Accordingly, the principles and function taught by the embodiment illustrated in FIGS. 6-10A apply, however, even greater structural integrity and functional consistency is achieved. It is noted that since the function of the second rib 240*b* is as spacer, the rib 240*b* may be segmented such that it is present only in the knuckle openings 230*a* of the first leaf 216 and not within the channels (236*b* or 236*c*) of the second leaf 218. The first rib 240*a* may also be segmented, so long as it serves to eliminate relative rotation between the second leaf 218 and pin 220, and allows a range of relative rotation between the first and second leaf 216, 218 up to engagement with the detents 238.

In use, the pin 220 is inserted into the openings 230*a*, 232*a* with the first rib 240*a* positioned into the channel (236*a* or 236*b*) which relates to the desired range of opening for the door 12 (i.e. about 0 to about 90 degrees of opening for channel 236*a*, and about 0 to about 180 degrees of opening for channel 236*b*). The second rib 240*b* is aligned with the channel (236*b* or 236*c*) subsequent from the channel (236*a* or 236*b*) in which the first rib 240*a* is disposed.

By the first rib 240*a* being positioned within one of the channels (236*a* or 236*b*), the pin 220 is in fixed relation to the second leaf 218. The first rib 240*a* also extends into the openings 230*a* of the first knuckle 224*a* whereat it engages against the detents 238 to stop the door from swinging further open. That is, as the door is being opened, the first leaf 216 rotates about the pin 220 until the first rib 240*a* engages the detents 238, causing the door to stop at a predetermined angle. And, should the first rib 240*a* seek to slip over the detent 238, movement of the pin 220 away from the detent 238 is restricted by the second rib 240*b* acting as a spacer by engaging against the interior surface of the first leaf knuckles 224*a*. As it will be understood by those skilled in the art, it is the combination of the rib 240*a* and detents 238 that determine how far the door can be opened.

To change the range of door movement, e.g. 0 to 180 degrees instead of 0 to 90 degrees, the pin 220 may be removed by use of a screw driver driving upward against a head 242 of the pin 220 until the pin 220 is fully released from the knuckles 224*a*, 226*a*. Thereafter, the pin 220 is reinserted into the knuckles 224*a*, 226*a*, but with the first rib 240*a* now being positioned into the newly chosen channel (e.g. 236*b*) and the second rib 240*b* in the succeeding channel (e.g. 236*c*).

Advantageously, the embodiment of FIGS. 11-15A allows for the same hinge 200 to be used on right-handed or left-handed swinging door by simply flipping and mounting the hinge 200 upside down, with the pin 242 being inserted through the top opening in either case.

It is also to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

That which is claimed is:

1. A hinge for a swinging door, comprising:

a first leaf having a knuckle, wherein said knuckle defines an opening and has a detent that protrudes into said opening;

a second leaf having a knuckle, wherein said knuckle defines an opening and has a first channel that is contiguous with said opening of said second leaf;

a pin positioned in said openings of said knuckles of said first and second leafs and pivotly attaching said first leaf to said second leaf;

wherein said pin has a first rib positionable within said first channel;

wherein relative rotation between said pin and said second leaf is restricted by engagement of said first rib against said first channel;

wherein said first leaf can be rotated relative to said second leaf through a predetermined range of motion;

wherein said predetermined range of motion is limited at one end of said predetermined range by engagement of said first rib against said detent;

wherein said pin includes a second rib that is radially spaced from said first rib;

wherein said second rib is disposed within said opening of said knuckle of said first leaf; and wherein said second rib spaces said pin within said opening of said knuckle of said first leaf whereby said first rib is prevented from slipping over said detent when said first rib engages said detent.

2. The hinge according to claim 1, wherein said second rib is unitary with said pin.

3. The hinge according to claim 1, wherein said knuckle of said second leaf includes a second channel that is contiguous with said opening of said second leaf and said second rib is aligned with said second channel when said first rib is within said first channel.

4. The hinge according to claim 3, wherein said knuckle of said second leaf includes a third channel that is contiguous with said opening of said second leaf, wherein said second and third channels are radially spaced apart from each other by about 90 degrees and wherein said second rib is aligned with said third channel when said first rib is positioned within said second channel.

5. A hinge for a swinging door, comprising:

a first leaf having first and second knuckles, wherein each of said first and second knuckles has an opening and a detent that protrudes into respective said opening;

a second leaf having a first, second and third knuckles, wherein each of said first, second and third knuckles has an opening and first and second channels that are contiguous with respective said opening;

a pin positioned in said openings of said first and second knuckles of said first leaf and said first, second and third knuckles of said second leaf and pivotly attaching said first leaf to said second leaf;

wherein said pin has a first rib positionable within said first channel of said first, second and third knuckles of said second leaf;

wherein relative rotation between said pin and said second leaf is restricted by engagement of said first rib against said first channel of said first, second and third knuckles of said second leaf;

wherein said first leaf can be rotated relative to said second leaf through a predetermined range of motion;

wherein said predetermined range of motion is limited at one end of said predetermined range by engagement of said first rib against said detent of said first and second knuckle of said first leaf; and wherein said pin has a second rib and said second rib is disposed within said opening of each of said first and second knuckles of said first leaf and said second rib spaces said pin within said opening of each of said first and second knuckles of said first leaf whereby said first rib is prevented from slipping over said detents when said first rib engages said detents.

6. The hinge according to claim 5, wherein said first and second ribs are unitary with said pin and each of said detent is unitary with respective said first and second knuckles of said first leaf.

7. The hinge according to claim 5, wherein each of said first, second and third knuckles of said second leaf includes a third channel that is contiguous with respective said opening of said first, second and third knuckles of said second leaf and said first, second and third channels are parallel to a centerline of said respective opening of said first, second and third knuckles of said second leaf and extend the longitudinal length of said first, second and third knuckles of said second leaf.

8. The hinge according to claim 7, wherein each of said second channel is radially spaced from each of said first channel of said first, second and third knuckles of said second leaf by about 90 degrees, and each of said third channel is radially spaced from each of said second channel of said first, second and third knuckles of said second leaf by about 90 degrees.

* * * * *